US012740634B2

(12) United States Patent
Gaurav et al.

(10) Patent No.: US 12,740,634 B2
(45) Date of Patent: Sep. 22, 2026

(54) BACKPACK DESIGNED AND ORGANIZED FOR PAINTING TOOLS

(71) Applicant: SWIMC LLC, Cleveland, OH (US)

(72) Inventors: Sharad Gaurav, Cleveland, OH (US); Edward R. Goodwin, Jr., Westlake, OH (US); Michael C. Lambertson, Jr., Aurora, OH (US)

(73) Assignee: SWIMC LLC, Cleveland, OH (US)

( * ) Notice: Subject to any disclaimer, the term of this patent is extended or adjusted under 35 U.S.C. 154(b) by 88 days.

(21) Appl. No.: 17/861,955

(22) PCT Filed: Jan. 29, 2021

(86) PCT No.: PCT/US2021/015901
§ 371 (c)(1),
(2) Date: Jul. 11, 2022

(87) PCT Pub. No.: WO2021/155287
PCT Pub. Date: Aug. 5, 2021

(65) Prior Publication Data

US 2024/0008625 A1 Jan. 11, 2024

Related U.S. Application Data

(60) Provisional application No. 62/967,882, filed on Jan. 30, 2020.

(51) Int. Cl.
*A45F 3/04* (2006.01)
*A45C 13/02* (2006.01)

(52) U.S. Cl.
CPC ..... *A45F 3/04* (2013.01); *A45C 13/02* (2013.01)

(58) Field of Classification Search
CPC ..... A45C 13/02
See application file for complete search history.

(56) References Cited

U.S. PATENT DOCUMENTS 2,712,336 A * 7/1955 Casselman ..... A45C 11/38 383/18
5,004,134 A 4/1991 Barry
(Continued)

FOREIGN PATENT DOCUMENTS

CA 2518127 A1 * 3/2007 ..... A45C 13/02
EP 2233254 A1 9/2010
(Continued)

OTHER PUBLICATIONS

International Search Report filed in the corresponding PCT Application; 3 pages.

(Continued)

*Primary Examiner* — Scott T Mcnurlen
(74) *Attorney, Agent, or Firm* — Tucker Ellis LLP

(57) ABSTRACT

In an example embodiment, there is disclosed herein a backpack that is designed and organized for the storage and transport of painting tools. The backpack is designed to include storage for painting tools such as, for example, brushes, rollers, roller handles, putty knives, and/or an extension pole with other pockets allowing for the storage and transport of personal items. In particular embodiments, the backpack includes specific storage capabilities for wet tools so that they can be stored and transported to a different location for cleaning.

16 Claims, 16 Drawing Sheets

(56) References Cited

U.S. PATENT DOCUMENTS

| | | | | |
|---|---|---|---|---|
| 5,209,384 | A | 5/1993 | Anderson | |
| 6,619,519 | B1 * | 9/2003 | Nix | A45C 7/0086 224/664 |
| 6,655,565 | B2 * | 12/2003 | Godshaw | A45F 4/02 224/655 |
| 7,694,862 | B2 * | 4/2010 | Bergeron | A45F 5/02 224/675 |
| 7,726,530 | B1 | 6/2010 | Exposito | |
| 8,079,503 | B1 * | 12/2011 | Yeates | A45C 7/0086 224/268 |
| 9,345,301 | B2 * | 5/2016 | Brouard | A45F 3/04 |
| 9,486,063 | B2 | 11/2016 | Roman | |
| 9,862,443 | B2 | 1/2018 | White, Jr. | |
| 9,992,574 | B2 | 6/2018 | Esses | |
| 10,010,159 | B1 * | 7/2018 | Gonzales | A45F 3/047 |
| 10,165,845 | B2 * | 1/2019 | Moreau | A45C 13/023 |
| 10,350,745 | B2 | 7/2019 | Zhang | |
| 2006/0118376 | A1 * | 6/2006 | Godshaw | A45C 7/0036 190/115 |
| 2008/0023513 | A1 * | 1/2008 | Hadj-Chikh | A45F 3/46 224/645 |
| 2009/0020580 | A1 | 1/2009 | Tate | |
| 2009/0307878 | A1 * | 12/2009 | Kadas | A45F 5/02 24/304 |
| 2010/0108730 | A1 * | 5/2010 | Sabbah | A45F 3/04 224/652 |
| 2011/0147428 | A1 * | 6/2011 | Crawford | A45C 11/24 224/245 |
| 2012/0085804 | A1 | 4/2012 | Christy | |
| 2015/0150357 | A1 | 6/2015 | Lourenco Ferreira | |
| 2016/0141904 | A1 | 5/2016 | Zhijian | |
| 2016/0249734 | A1 | 9/2016 | Roman | |
| 2018/0152037 | A1 * | 5/2018 | Yu | A45C 5/03 |
| 2019/0191837 | A1 | 6/2019 | Richards | |
| 2019/0223579 | A1 * | 7/2019 | Postolek | A45C 5/06 |

FOREIGN PATENT DOCUMENTS

| | | | |
|---|---|---|---|
| WO | 2009102319 | A1 | 8/2009 |
| WO | 2019135922 | A1 | 7/2019 |

OTHER PUBLICATIONS

Written Opinion filed in the corresponding PCT Application; 6 pages.

Purdy Paint Tools: "The Purdy Painter's Backpack", Youtube; Dec. 6, 2019, p. 9 pp., XP054981716 Retrieved from the Internet: URL: https://www.youtube.com/watch?v=YW3MUug8YtQ [retrieved on Apr. 27, 2021] the whole document.

Screenshots of "The Purdy Painter's Backpack", Youtube video URL: https://www.youtube.com/watch?v=YW3MUug8YtQ.

* cited by examiner 74
82
80
140
140
140

142

144

BACKPACK DESIGNED AND ORGANIZED FOR PAINTING TOOLS

CROSS REFERENCE TO RELATED APPLICATIONS

This application is a National Stage entry under 35 U.S.C. § 371 from International application No. PCT/US21/15901, filed Jan. 29, 2021 that claims the benefit of U.S. Provisional Application No. 62/967,882, filed Jan. 30, 2020. The entire contents of the aforementioned application are hereby incorporated by reference herein.

TECHNICAL FIELD

The present disclosure relates generally to back packs.

BACKGROUND

Backpacks are often employed to carry items. Backpacks generally have shoulder straps. A user can put their arms through the shoulder straps and the backpack rests upon the users back and shoulders.

SUMMARY OF EXAMPLE EMBODIMENTS

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, there is disclosed herein a backpack that is designed and organized for the storage and transport of painting tools. In particular embodiments, the backpack includes specific storage capabilities for wet tools so that they can be stored and transported to a different location for cleaning.

BRIEF DESCRIPTION OF THE DRAWINGS

The accompanying drawings incorporated herein and forming a part of the specification illustrate the example embodiments.

DESCRIPTION OF EXAMPLE EMBODIMENTS

Figure 1:
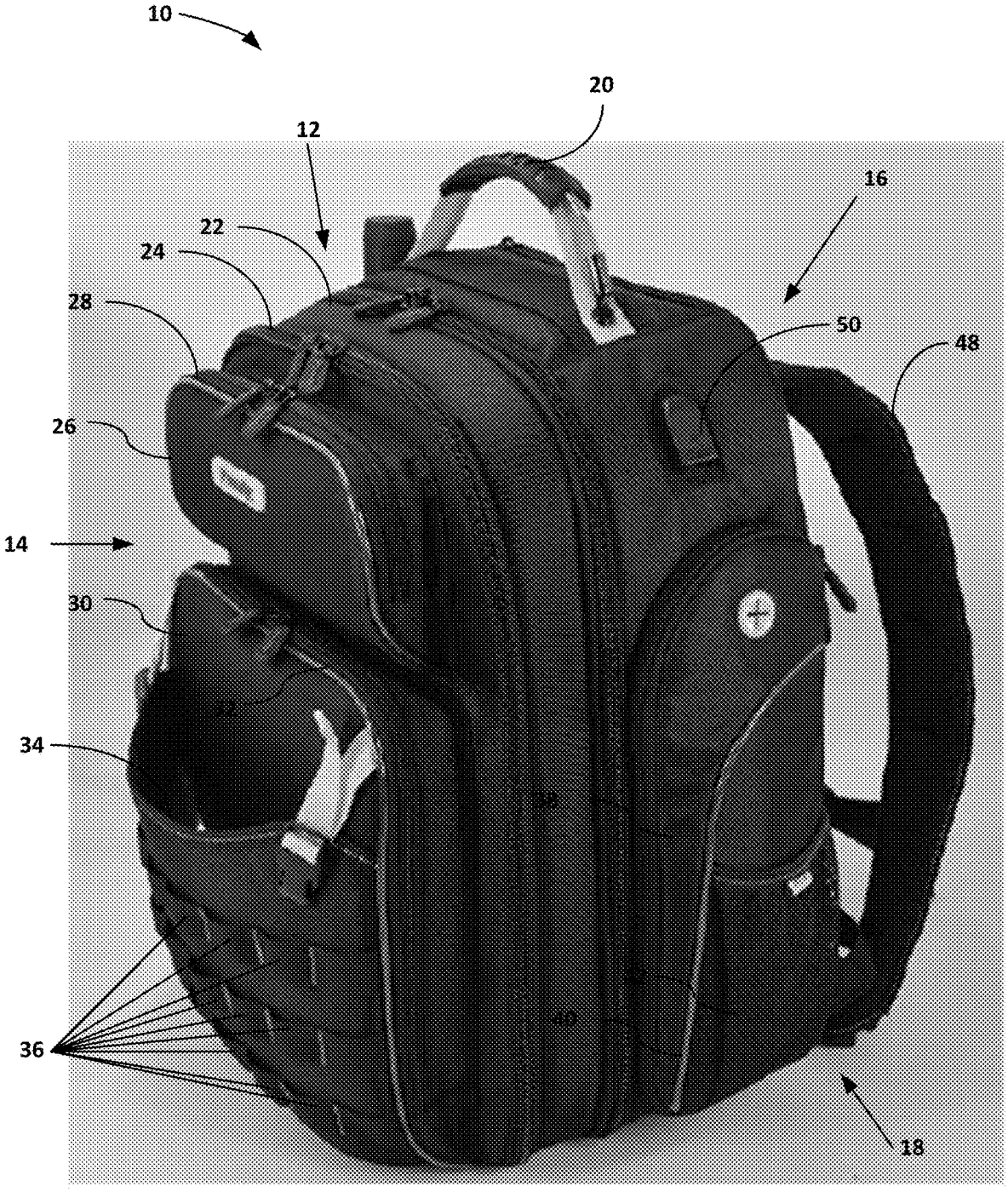
FIG. 1 is a perspective view of a backpack in accordance with an example embodiment.

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

In an example embodiment, there is disclosed herein a backpack that is designed and organized for the storage and transport of painting tools. The backpack is designed to include storage for painting tools such as, for example, brushes, roller frames, roller covers, putty knives, and/or an extension pole with other pockets allowing for the storage and transport of personal items. In particular embodiments, the backpack includes specific storage capabilities for wet tools so that they can be stored and transported to a different location for cleaning.

Referring to the figures, FIGS. 1-7 illustrate various exterior views of a backpack 10 in accordance with an example embodiment. The backpack comprises a first (top) surface 12, a second (front) surface 14, a third (rear) surface 16, a fourth (right) surface 18, a fifth (left) surface 44, and a sixth (bottom) surface 52.

The top surface 12 comprises a handle 20 and zippers 22, 24. The handle 20 comprises a reinforcing member 60 and a grip 64. Zippers 22, 24 allow access to first and second interior compartments respectively which will be described in further detail herein infra (see e.g., references 72, 74 in FIG. 9).

The front surface 14 comprises a top pocket 26 and a bottom pocket 30. Zippers 28 provide access to the top pocket 26 and zippers 32 provide access to the bottom pocket 30. In an example embodiment, the top pocket 26 is lined with a soft material and can be employed for storing items such as glasses or safety eyewear.

In an example embodiment, an external pocket 34 is located outside of bottom pocket 30. Slots 36 are formed by material on the front of the external pocket 34. As will be described herein infra, the slots 36 can be employed for attaching items to the backpack 10.

The left surface 44 comprises an extension pole pocket 46. The extension pole pocket 46 is sized to fit an extension pole (not shown). Outside of the extension pole pocket 46 are slots 36 that can be employed for attaching items to the backpack 10.

The right surface 18 comprises a pocket 38. Access to the pocket 38 is provided by zipper 40. An external pocket 42 is located outside of pocket 38. In an example embodiment, the external pocket 42 is a mesh and is configured to hold common beverage containers. The right surface further comprises a universal serial bus ("USB") port 50.

The bottom surface 52 comprises feet 54. Feet 54 can provide stability to the backpack 10 while the bottom surface 52 is located on a horizontal surface (not shown, e.g., on a floor, table, or the ground). Feet 54A are located underneath the first interior compartment (e.g., 72 in FIG. 9) and feet 54B are located underneath the second interior compartment (e.g., 74 in FIG. 9). In an example embodiment, the feet 54 are rubber or a similar material.

A pocket 56 is located on the top surface 12 adjacent to the rear surface 16. Access to the pocket 56 is provided by zipper 58. In an example embodiment, pocket 56 is sized to fit personal items such as a wallet.

Figure 8:
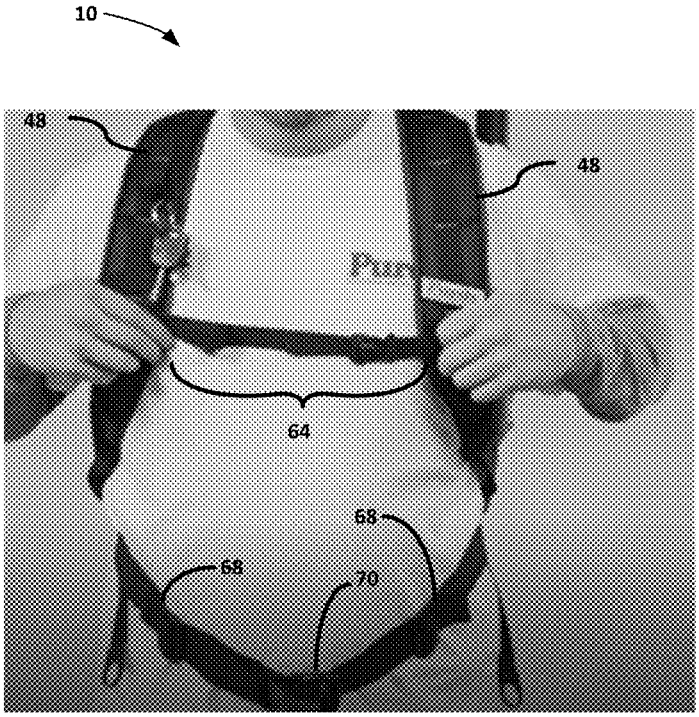
FIG. 8 illustrates an example of the backpack illustrated in FIG. 1.

The rear surface 16 comprises shoulder straps 48. A user places their arms through shoulder straps 48 to wear the backpack 10 on their back. Chest straps 46 are attached to the shoulder straps 48. In an example embodiment, the chest straps further comprise engaging mechanisms 66. Engaging mechanisms 66 may be any suitable device for holding the shoulder straps 48 together, such as for example, clasps, male/female snaps, hook, and loop (e.g., VELCRO), buckles, etc. In an example embodiment, the rear surface 16 comprises waist straps 68 which are configured to wrap around a user's waist. The straps 68 are held together by engaging mechanisms 70. Engaging mechanism 709 may be any suitable engaging mechanisms, such as, for example, the types of engaging mechanisms described for engaging mechanisms 66. FIG. 8 illustrates an example of a user employing both chest straps 64 and waist straps 68. Those skilled in the art can readily appreciate that in other embodiments only one of chest straps 64 or belt straps 68 may be employed and in particular embodiments there are no straps.

Figure 2:
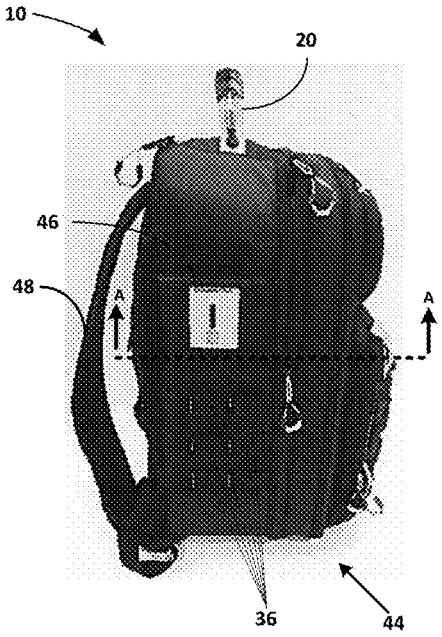
FIG. 2 is a view of the left side of the backpack illustrated in FIG. 1.
Figure 3:
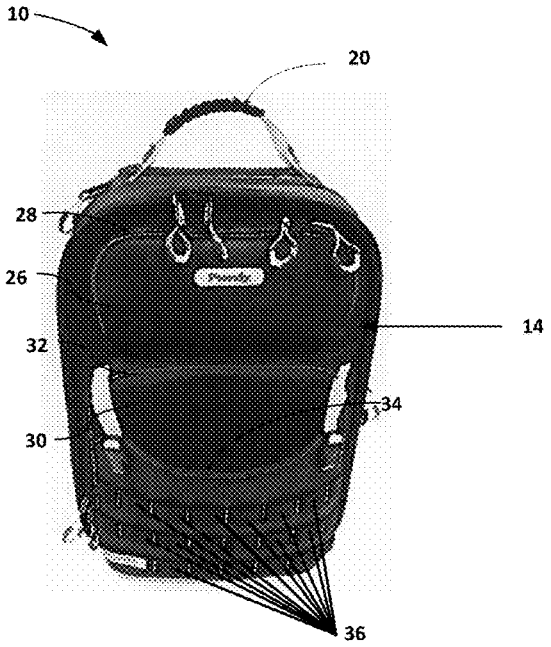
FIG. 3 is a front view of the backpack illustrated in FIG. 1.
Figure 4:
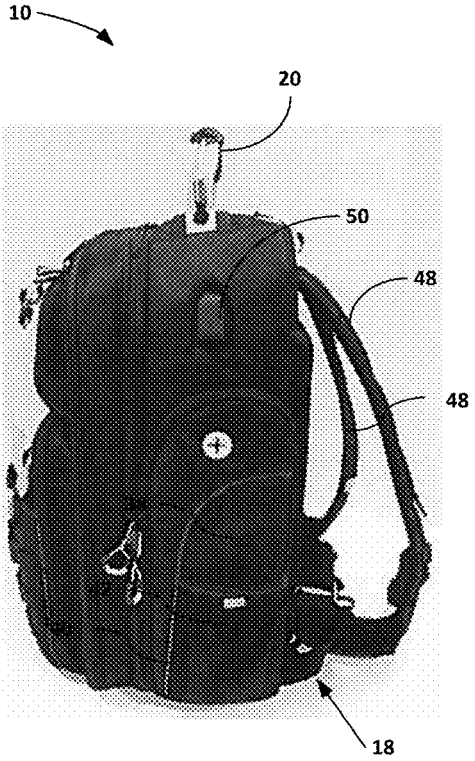
FIG. 4 is a view of the right side of the backpack illustrated in FIG. 1.
Figure 5:
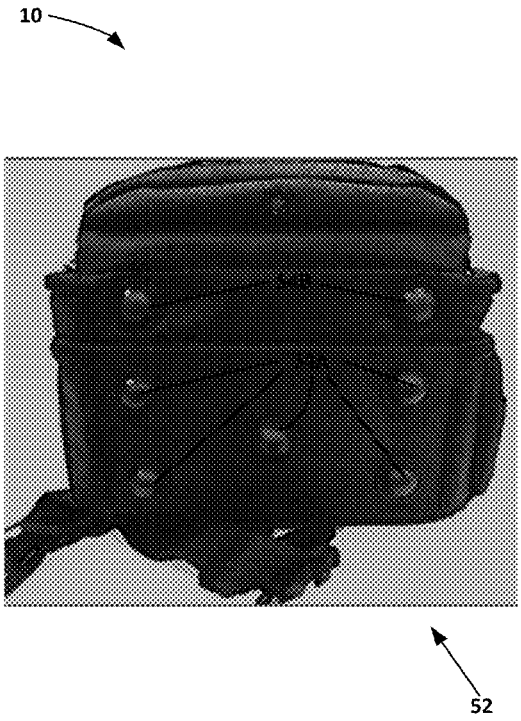
FIG. 5 is a view of the bottom of the backpack illustrated in FIG. 1.
Figure 6:
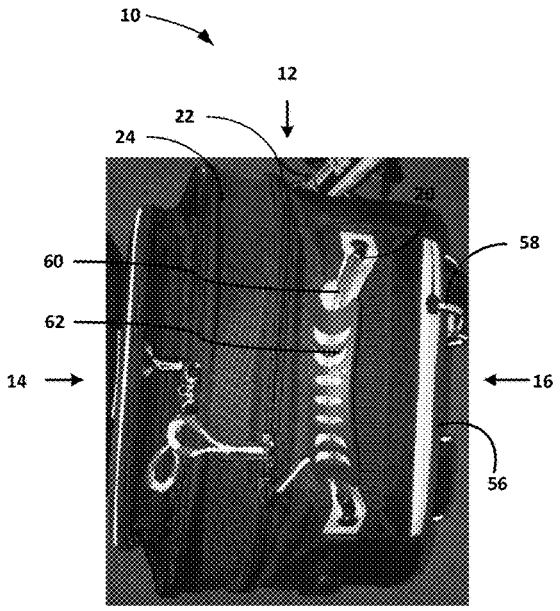
FIG. 6 is a top view of the backpack illustrated in FIG. 1.
Figure 7:
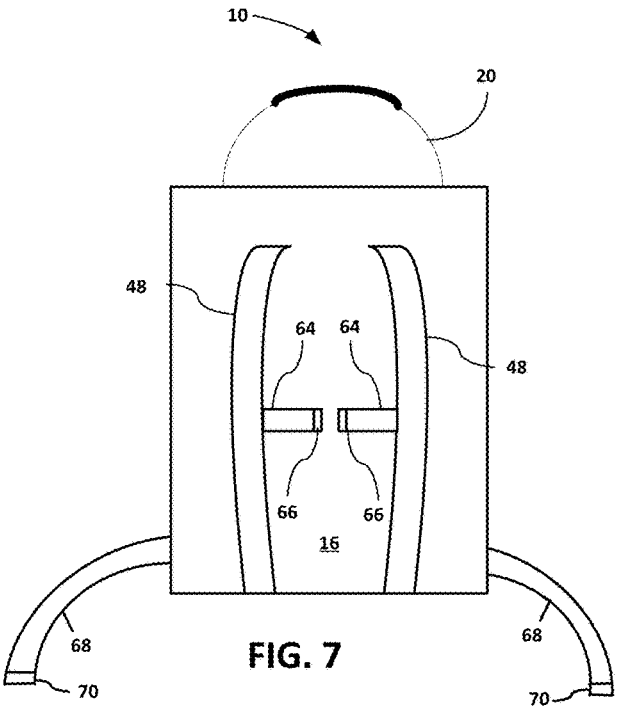
FIG. 7 is a rear view of the backpack illustrated in FIG. 1.
Figure 9:
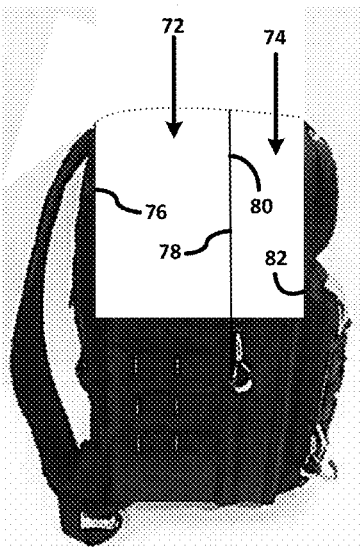
FIG. 9 illustrates a simplified cutaway view of the right side of the backpack along line A-A in FIG. 2.

FIG. 9 illustrates a simplified cutaway view of the right side of the backpack along line A-A in FIG. 2. FIG. 9 illustrates the location of the first interior compartment 72 and the second interior compartment 74. The first interior compartment 72 comprises a first internal panel 76 and a second internal panel 78. The second interior compartment 64 comprises a third internal panel 80 and a fourth internal panel 82. Example configurations of the first and second compartments 72, 74 and panels 76, 78, 80, 82 will be described herein infra.

Figure 10:
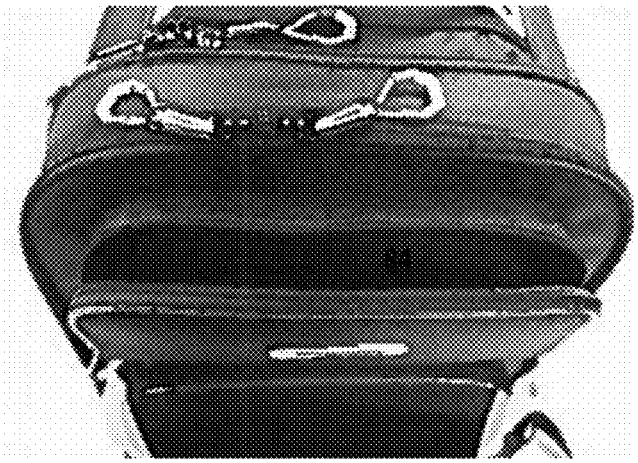
FIG. 10 illustrates an example of the interior of a pocket located at the top of the front surface of the backpack illustrated in FIG. 1.

FIG. 10 illustrates an example of the upper interior 84 of a pocket 26 located at the top of the front surface 14 of the backpack 10 illustrated in FIG. 1. In an example embodiment, the interior 84 of the top pocket 26 is lined with a soft material and can be employed for storing items such as glasses, safety eyewear, or other items which may easily be scratched.

Figure 11:
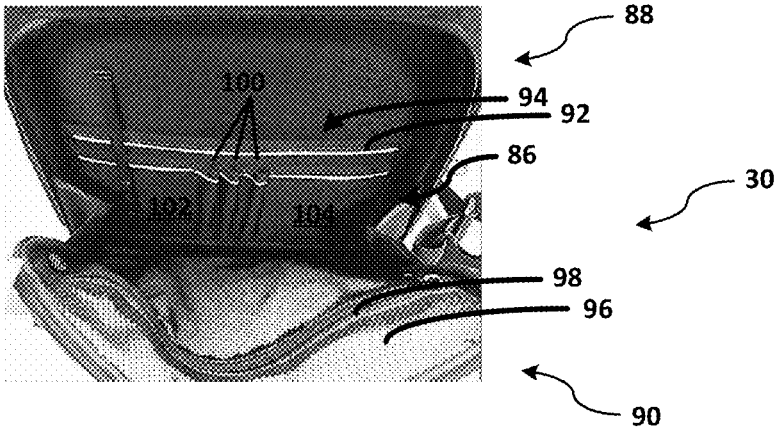
FIG. 11 illustrates an example of the interior of a pocket located at the bottom of the front surface of the backpack illustrated in FIG. 1.

FIG. 11 illustrates an example of the interior 86 of the lower pocket 30 located on the front surface 14 of the backpack illustrated in FIG. 1. The pocket 30 has a first side 88 and a second side 90. A flap 92 is attached to the first side 88 of the pocket 30 and forms an internal pocket 94. A mesh 96 is located on the second side 90 of the pocket 30 and can be employed for storage. Zipper 98 provides access to the area encompassed by the mesh 96. A plurality of cylindrical storage areas 100 can be employed for holding writing utensils such as pens and/or pencils. Located on flap 92 are additional first 102 and second 104 (or left and right) pockets, respectively.

Figure 12:
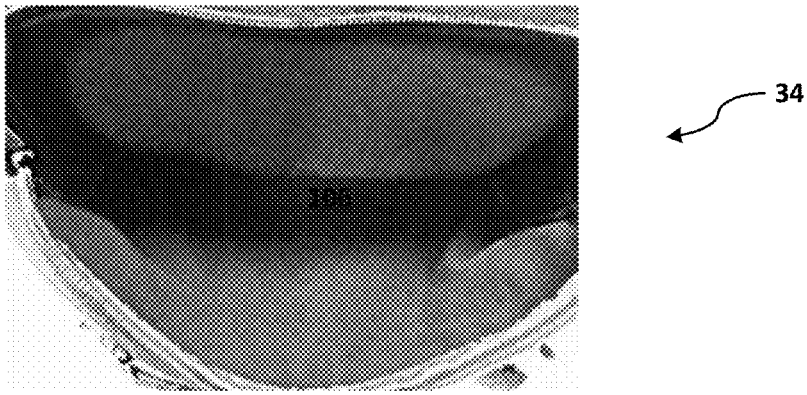
FIG. 12 illustrates an example the exterior pocket coupled with the pocket located at the bottom of the front surface of the backpack illustrated in FIG. 1.

FIG. 12 illustrates an example the exterior pocket 34 coupled with the pocket 34 located at the bottom of the front surface 14 of the backpack 10 illustrated in FIG. 1. The pock et 34 has an interior area 106.

Figure 13:
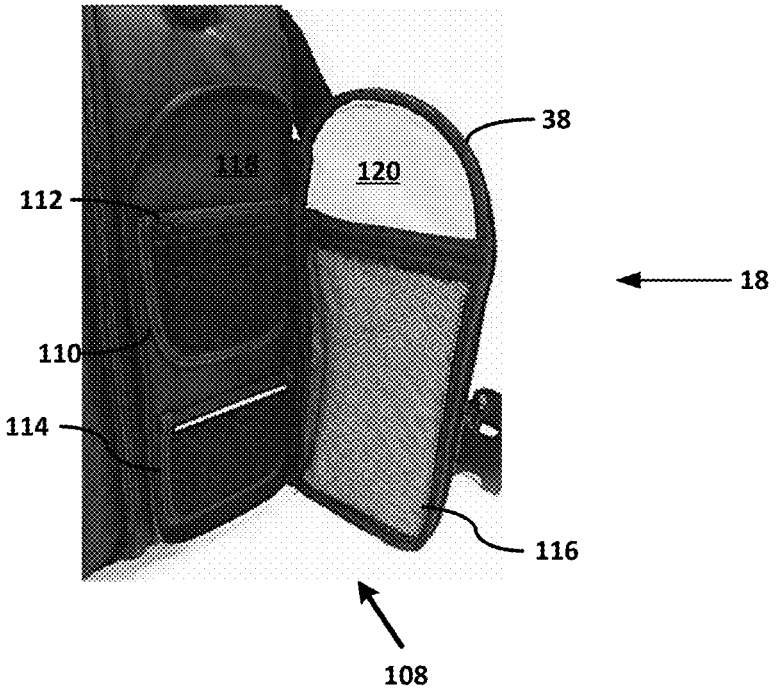
FIG. 13 illustrates an example of the interior of the pocket on the right surface of the backpack illustrated in FIG. 1.

FIG. 13 illustrates an example of the interior 108 of the pocket 38 on the right surface 18 of the backpack 10 illustrated in FIG. 1 The interior 108 of the pocket has a first interior surface 118 and a second interior surface 120. The first interior surface 118 has an upper pocket 110 and a lower pocket 114. Access to the upper pocket 110 is provided by zipper 112. A mesh pocket 116 is located on the second surface 120.

Figure 14:
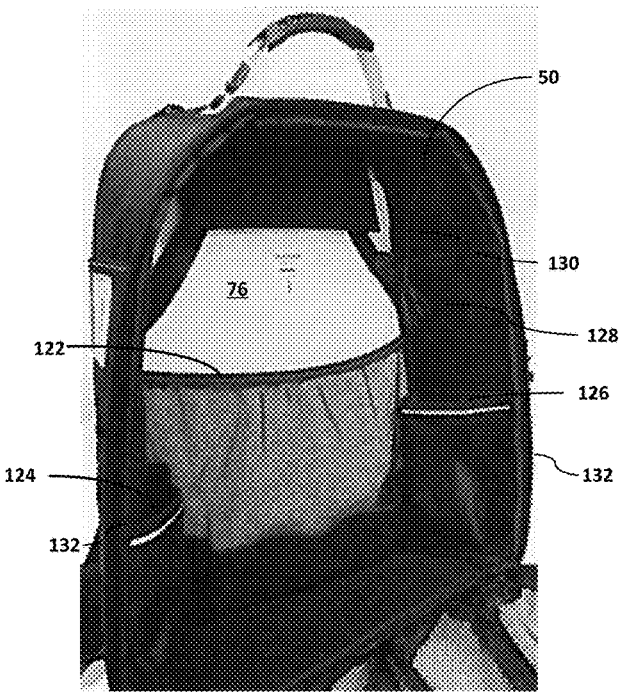
FIG. 14 illustrates an example of a first panel of a first interior compartment.

FIG. 14 illustrates an example of a first panel 76 of a first interior compartment 72. The first panel comprises a mesh pocket 122 and pockets 124, 126, and 128 located along a sidewall 132 of the first panel 76. Mesh pocket 122 is sized and configured to fit a paint roller frames. In particular embodiments, mesh pocket 122 can hold up to eighteen inch paint roller frames. As will be illustrated herein infra, sidewalls 132 allow for the storage of various other items within first interior compartment 72.

In an example embodiment, a USB cable 130 can be coupled with USB port 50. Because pocket 12is located adjacent to USB port 50, a power source or other device may be placed into pocket 128 and coupled via USB cable 130 to USB port 50 to provide power and/or data to an external device coupled to USB port 50.

Figure 15:
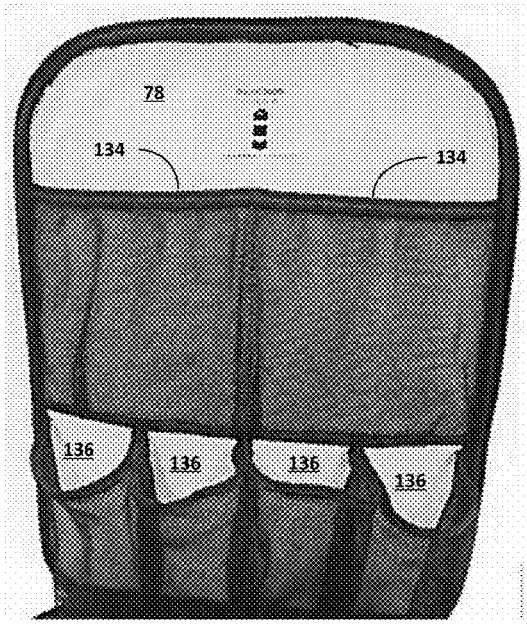
FIG. 15 illustrates an example of a second panel of a first interior compartment.

FIG. 15 illustrates an example of a second panel 78 of a first interior compartment 72. In the illustrated example, the second panel comprises upper pockets 134 and lower pockets 136 that are sized and configured to hold roller covers of various sizes. For example, smaller roller covers can be placed in upper pockets 134 while larger roller covers can be placed into pockets 136.

Figure 16:
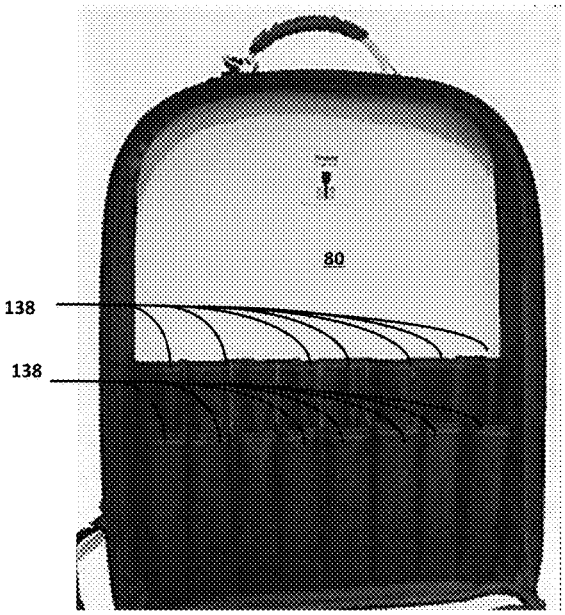
FIG. 16 illustrates an example of a first panel of a second interior compartment.

FIG. 16 illustrates an example of a first panel 80 of a second interior compartment 74. Panel 80 comprises a plurality of pockets 138 that are configured and sized to hold paint brushes of various sizes.

Figure 17:
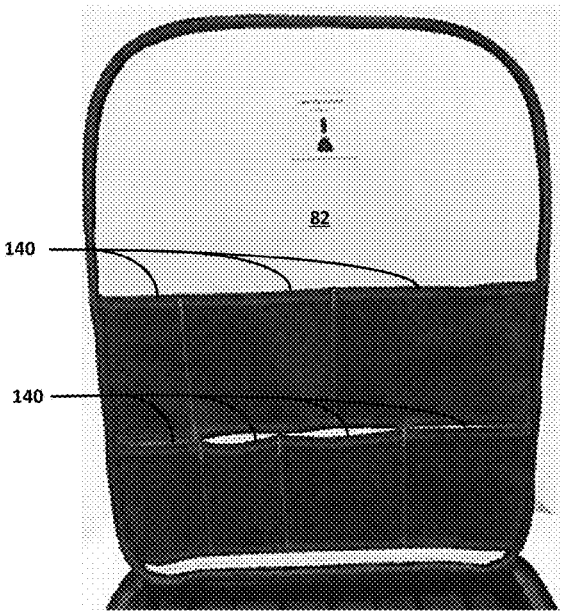
FIG. 17 illustrates an example of a second panel of a second interior compartment.

FIG. 17 illustrates an example of a second panel 82 of a second interior compartment 74. Panel 82 comprises pockets 140 sized and configured to hold tools, such as, for example, putty knives of various sizes.

Figure 18:
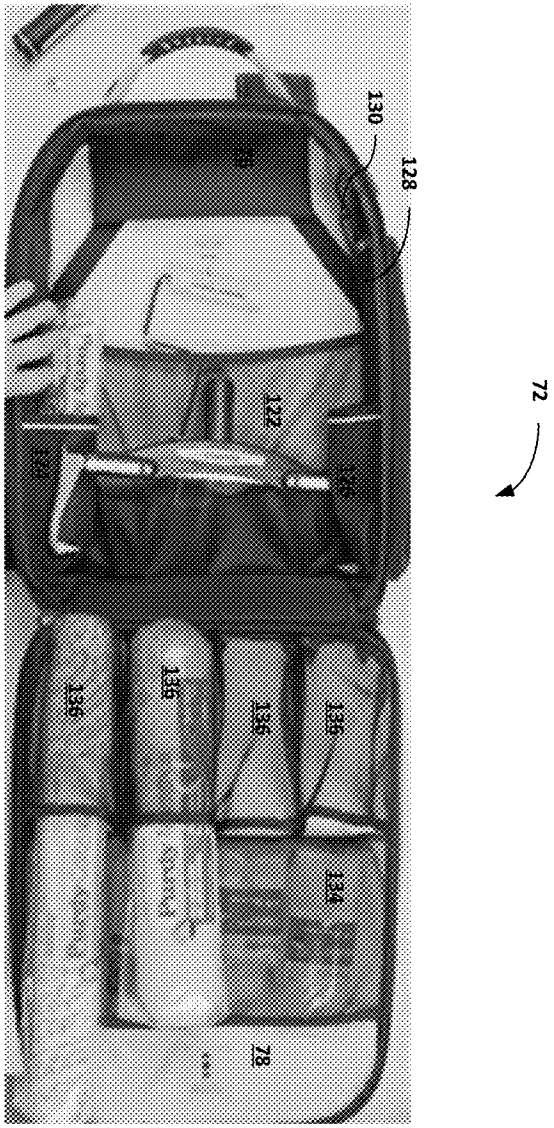
FIG. 18 illustrates an example of the first compartment with various painting supplies stored therein.

FIG. 18 illustrates an example of the first compartment 72 with various painting supplies stored therein. The example illustrates a pain roller frame and other items stored in internal panel 76 and paint roller covers stored in the second internal panel 78.

Figure 19:
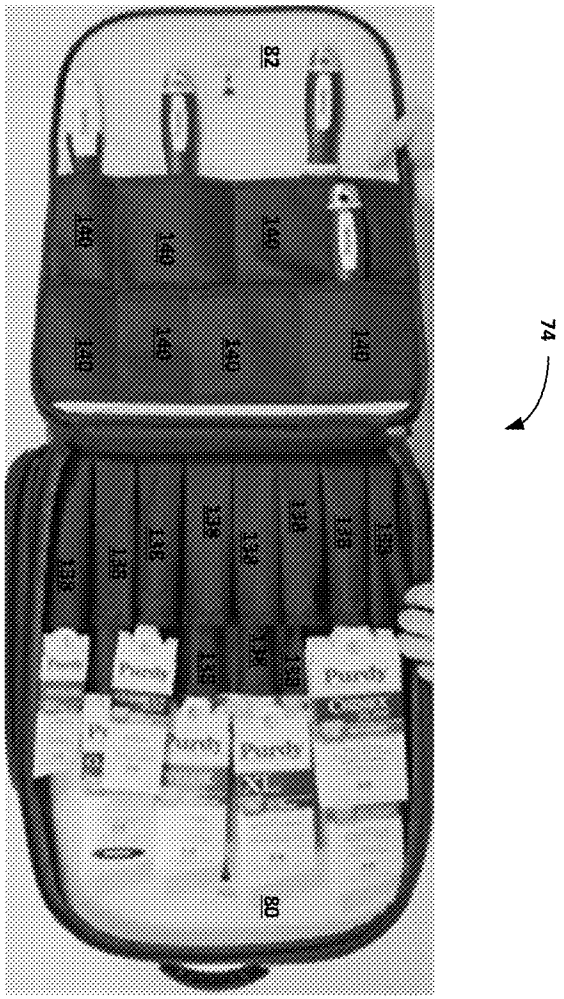
FIG. 19 illustrates an example of the second compartment with various painting supplies stored therein.
Figure 20:
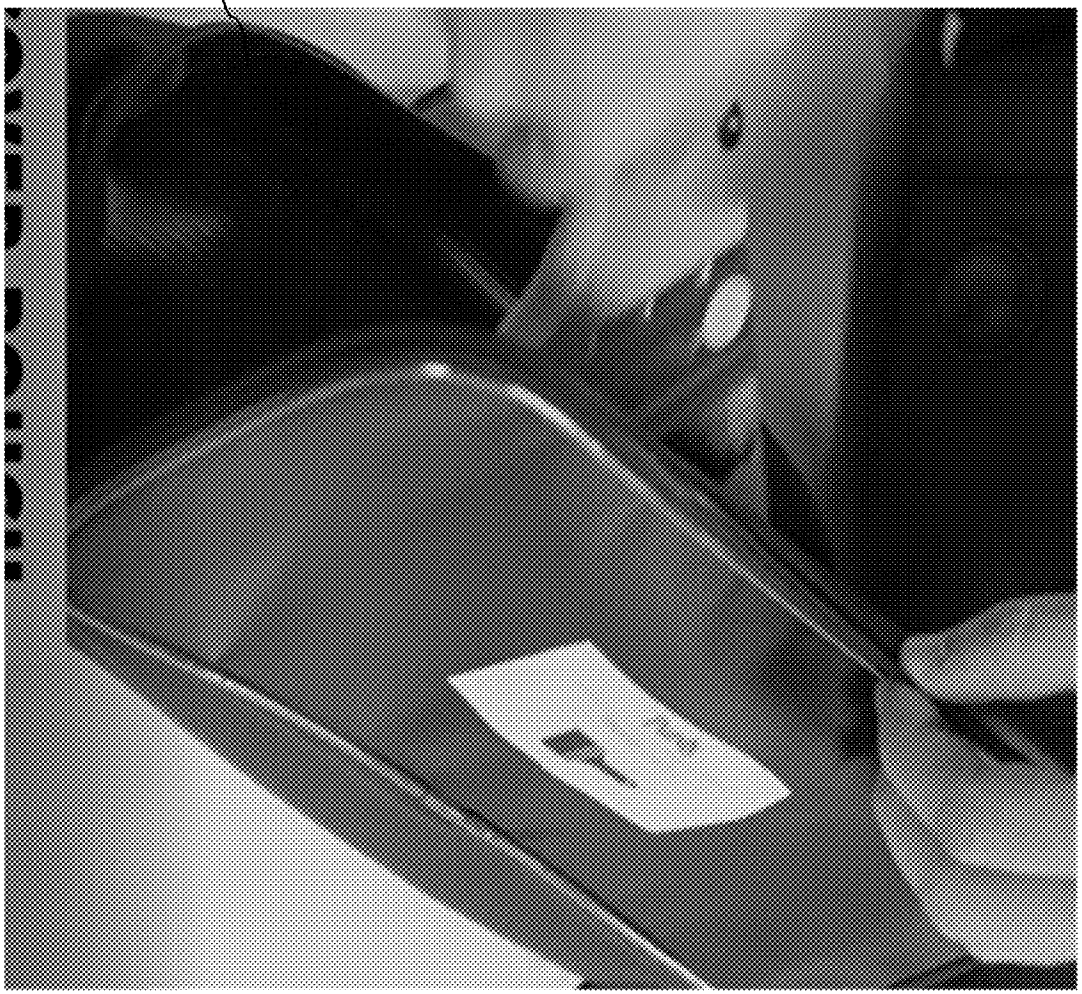
FIG. 20 is a perspective view of a pouch in accordance with an example embodiment.
Figure 21:
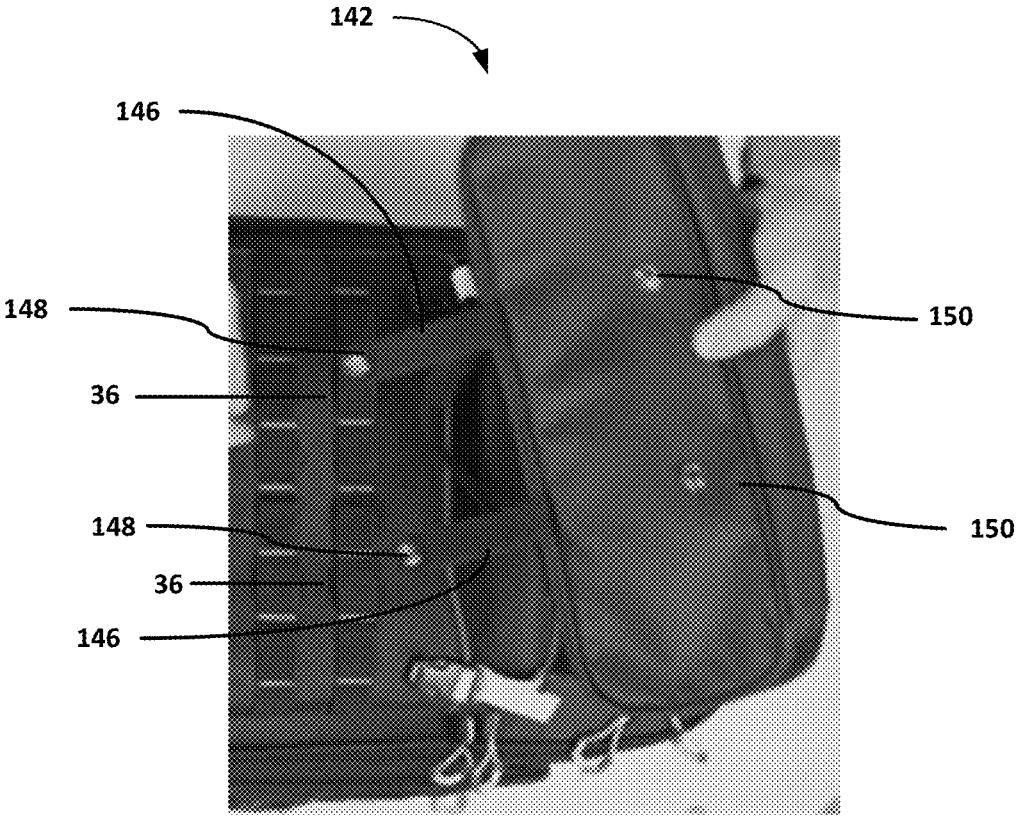
FIG. 21 is a view of the pouch illustrated in FIG. 20 showing an example of straps attached to the pouch that enable the pouch to engage slots on the backpack.
Figure 22:
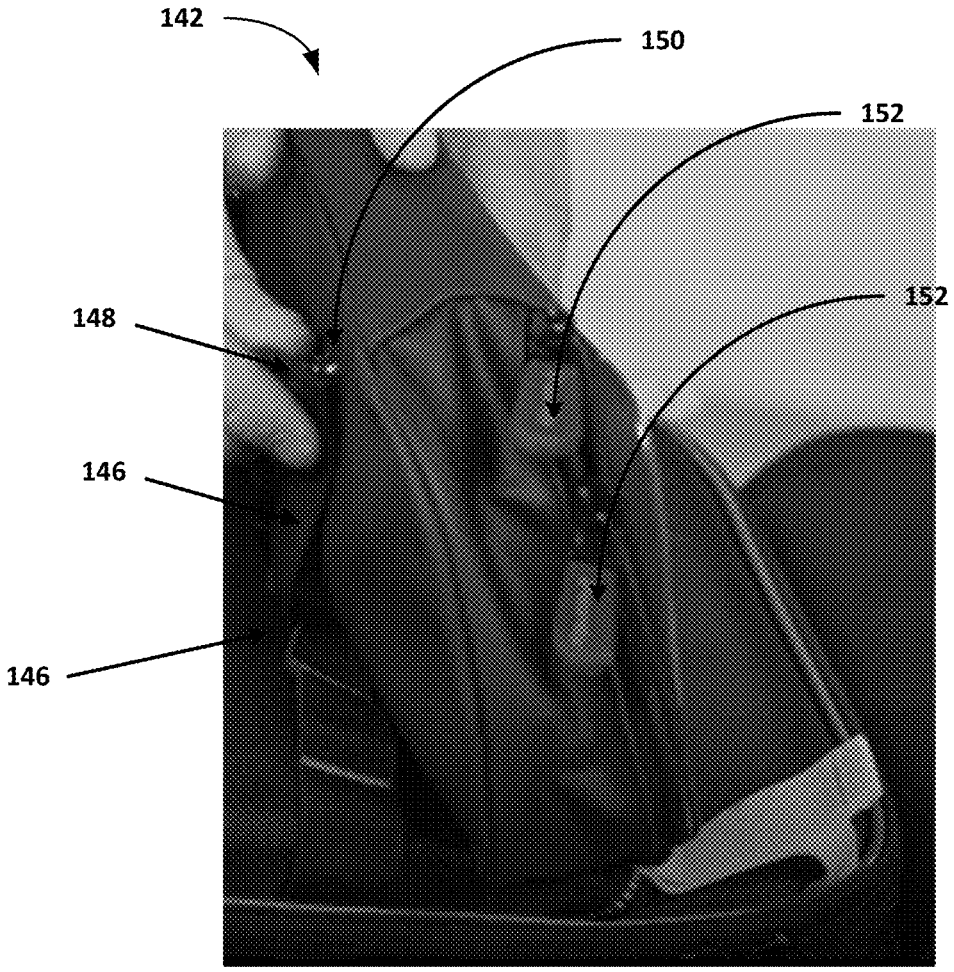
FIG. 22 illustrates an example of the snap being engaged to hold the pouch onto the backpack.
Figure 23:
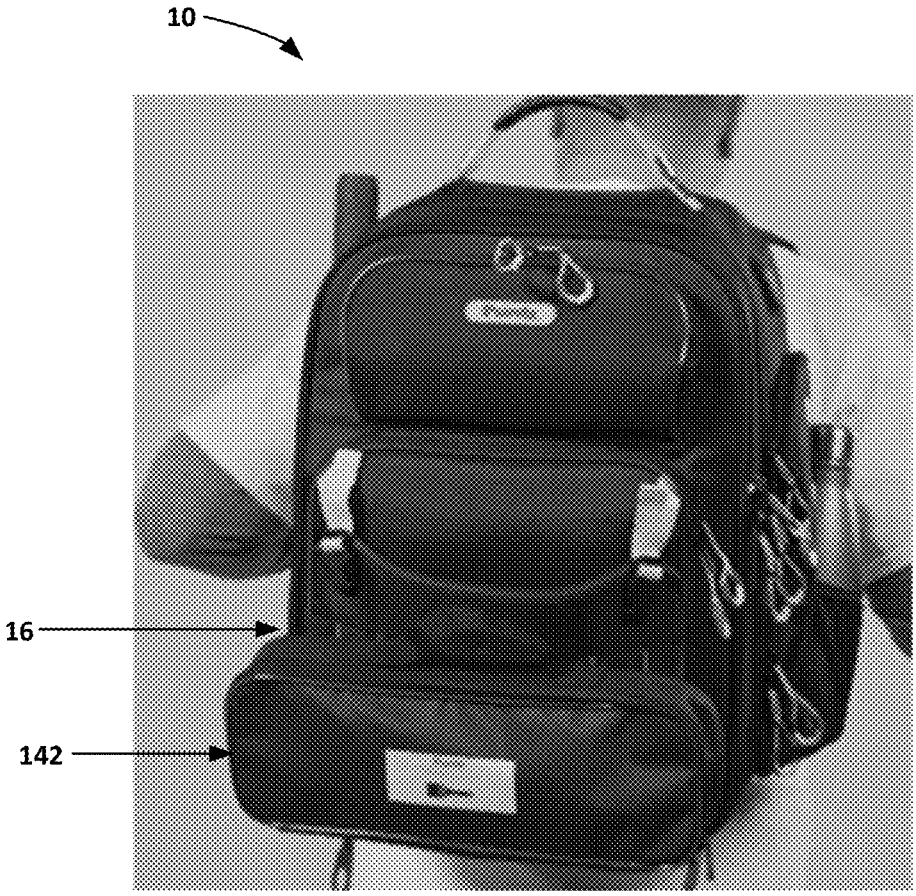
FIG. 23 illustrates an example of the backpack with the pouch attached thereon.

FIG. 19 illustrates an example of the second compartment 74 with various painting supplies stored therein. For example, brushes of various sizes are stored in pockets 138 of panel 80 and tools of various sizes are stored in pockets 140 of panel 82.

FIGS. 20-23 illustrate various views of a pouch 142 that can be employed for transporting wet painting supplies (e.g., brushes or roller covers). The pouch 142 has an interior compartment 144 that can be accessed via zippers 152. The pouch 142 further comprises straps 146 and female and male snaps 148, 150 respectively. As those skilled in the art can readily appreciate, the locations of the female and male snaps 148, 150 respectively can be swapped. Strap 148 is sized to fit within slots 36 on the front surface 14 so that pouch 142 will be attached to backpack 10 when the male 150 and female 148 parts of the snap are engaged with the strap looped around one or more of slots 36.

Figure 24:
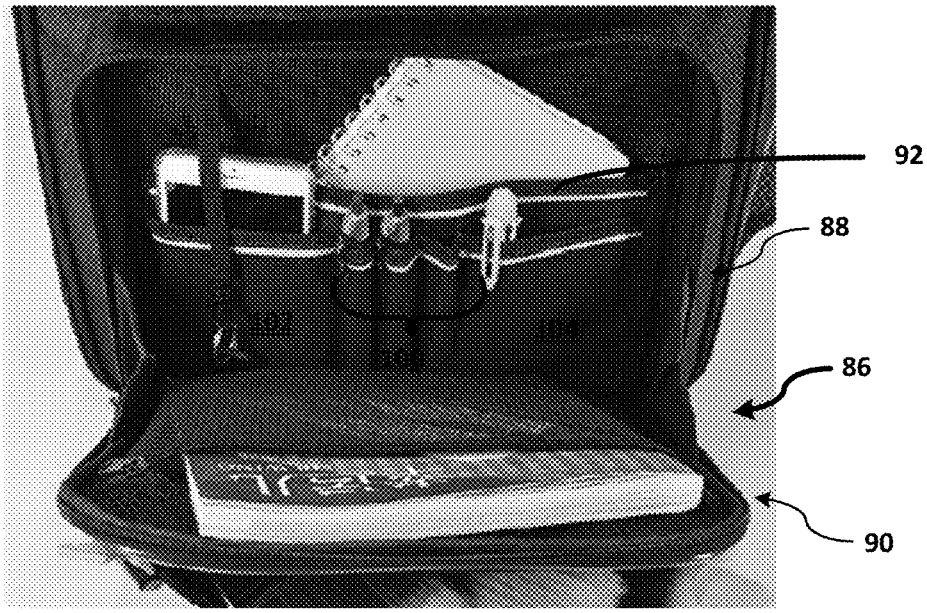
FIG. 24 illustrates an example of contents that can be held in the interior of the lower pocket located on the front surface of the backpack.

FIG. 24 illustrates an example of contents that can be held in the interior 86 of the lower pocket 30 located on the front surface 14 of the backpack 10. In the illustrated example, the contents include a calculator, note pad, book, and pens, although those skilled in the art can readily appreciate various other items may be stored in therein.

Described above are example embodiments. It is, of course, not possible to describe every conceivable combination of components or methodologies for purposes of describing the example embodiments, but one of ordinary skill in the art will recognize that many further combinations and permutations of the example embodiments are possible. Accordingly, it is intended to embrace all such alterations, modifications and variations that fall within the spirit and scope of any claims filed in applications claiming priority hereto interpreted in accordance with the breadth to which they are fairly, legally and equitably entitled.

The invention claimed is:

1. A backpack, comprising:

a top surface, a front surface, a rear surface, a right surface, a left surface, and a bottom surface;

a first interior compartment that comprises a first interior panel, a second interior panel, and a sidewall adjacent to the first interior panel, the first interior panel having a width and comprises a single mesh pocket that extends across the width of the first interior panel and configured to fit paint roller frames, the second interior panel comprises a plurality of upper pockets and a plurality of lower pockets that are sized and configured to hold roller covers of different sizes, and the sidewall comprises a first pocket adjacent to a first side of the first panel, a second pocket adjacent to a second side of the first panel, and a third pocket that is adjacent to the second side of the first panel, wherein the third pocket is below the second pocket;

a second interior compartment that comprises a third interior panel and a fourth interior panel, the third interior panel comprises a plurality of pockets sized to hold paint brushes of various sizes and the fourth interior panel comprises pockets sized to hold putty knives of various sizes;

a bottom pocket on the front surface;

a top pocket on the front surface;

an external pocket located outside of the bottom pocket, the external pocket having an opening at its top incapable of being closed, wherein an interior area of the external pocket is exposed;

a plurality of slots located on the external pocket; and a pouch having an interior compartment for transporting wet painting supplies and straps with male and female snaps, the straps being sized to fit within the slots on the front surface to couple the pouch to the front surface, wherein the rear surface comprises shoulder straps and chest straps that are coupled with the shoulder straps, the chest straps further comprising an engaging mechanism for holding the shoulder straps together, wherein the left surface further comprises an extension pole pocket and a plurality of slots for attaching items to the backpack located on the outside of the extension pole pocket, wherein the right surface further comprises an interior pocket and an external pocket located outside of the interior pocket, and wherein the top surface further comprises a pocket with a zipper for controlling access to the pocket, a paint roller frame configured to fit in the single mesh pocket;

a plurality of roller covers configured to be received in the plurality of upper pockets and plurality of lower pockets in the second interior panel;

a plurality of paint brushes configured to be received in the plurality of pockets in the third interior panel; and a plurality of putty knives configured to be received in the pockets in the fourth interior panel.

2. The backpack set forth in claim 1, wherein the top pocket of the front surface comprises a first side and a second side, a flap on the first side of the top pocket forms an internal pocket and a mesh pocket is located on the second side of the top pocket of the front surface, and a plurality of cylindrical storage areas for storing writing utensils, the flap comprises first and second pockets.

3. The backpack set forth in claim 1, wherein the top surface further comprises first and second zippers providing access to the first and second compartments respectively.

4. The backpack set forth in claim 1, wherein the external pocket on the right surface is a mesh pocket.

5. The backpack set forth in claim 1, wherein the interior pocket on the right surface comprises a first interior surface and a second interior surface, the first interior surface has an upper pocket and a lower pocket, the second interior surface of the pocket on the right surface comprises a mesh pocket.

6. The backpack set forth in claim 1, wherein the bottom surface further comprises a first plurality of rubberized feet located under the first interior compartment and a second plurality of rubberized feet located under the second interior compartment.

7. The backpack set forth in claim 1, wherein the right surface further comprises a universal serial bus port.

8. The backpack set forth in claim 7, further comprising a universal serial bus cable coupled with the universal serial bus port the universal serial bus cable is located within the first interior compartment.

9. The backpack set forth in claim 1, further comprising a plurality of slots on an exterior surface of the extension pole pocket for attaching items thereto.

10. The backpack set forth in claim 1, further comprising: the front surface further comprises a top pocket and a bottom pocket; and an external pocket located outside of the bottom pocket of the front surface; wherein the bottom pocket comprises:

a first side and a second side, a flap that comprises first and second pockets and is attached to the first side of the pocket and forms an internal pocket, a mesh that is located on the second side of the pocket for storage, a zipper that provides access to the area encompassed by the mesh, and a plurality of cylindrical storage areas configured for holding writing utensils.

11. The backpack set forth in claim 1, wherein the fourth panel pockets comprise a row of pockets that includes at least one first pocket having a first size and at least one second pocket having a second size that is different than the first size.

12. The backpack set forth in claim 1, wherein the single mesh pocket is sized and configured to hold an eighteen inch paint roller frame.

13. The backpack as set forth in claim 1, further comprising a strap coupled to the bottom pocket, the strap being coupled to a first buckle clip, and a second buckle clip coupled to the external pocket for mating with the first buckle clip, wherein the strap is adjustable to expand or retrack the external pocket.

14. A backpack, comprising:

a first body having a back, a top, a bottom, and side walls, wherein a front surface of the back forms a first interior panel having a width and comprising a single mesh pocket that extends across the width of the first interior panel and is configured to fit paint roller frames, wherein one of the side walls comprises a first pocket adjacent to a first side of the first interior panel, a second pocket adjacent to a second side of the first interior panel, and a third pocket that is adjacent to the second side of the first interior panel, wherein the third pocket is below the second pocket;

a second body having a back, a top, a bottom, and sides, wherein a back surface of the back forms a second interior panel comprising a plurality of upper pockets and a plurality of lower pockets that are sized and configured to hold roller covers of different sizes, and wherein a front surface of the back forms a third interior panel comprising a plurality of pockets sized to hold paint brushes of various sizes; and a third body having a back, a top, a bottom and sides, wherein a back surface of the back forms a fourth interior panel comprising pockets sized to hold putty knives of various sizes, wherein the first body and second body define a first interior compartment, wherein the second body and third body define a second interior compartment, wherein the first and second bodies are secured together at their bottoms and held in a closed position by one or more zippers extending along the tops and sides of the first and second bodies to the bottoms of the first and second bodies where the front surface of the back of the first body faces the back surface of the back of the second body when coupled together, and the one or more zippers are movable to an open position where the front surface of the back of the first body and the back surface of the back of the second body face the same direction, wherein the second and third bodies are secured together at their bottoms and held in a closed position by one or more zippers extending along the tops and sides of the second and third bodies to the bottoms of the second and third bodies where the front surface of the back of the second body faces the back surface of the back of the third body when coupled together, and the one or more zippers are movable to an open position where the front surface of the back of the second body and the back surface of the back of the third body face the same direction, and wherein one of the side walls of the first body has an extension pole pocket and a plurality of slots for attaching items to the backpack located on the outside of the extension pole pocket, and the other of the side walls includes an external pocket for beverage containers, a paint roller frame configured to fit in the single mesh pocket;

a plurality of roller covers configured to be received in the plurality of upper pockets and plurality of lower pockets in the second interior panel;

a plurality of paint brushes configured to be received in the plurality of pockets in the third interior panel; and a plurality of putty knives configured to be received in the pockets in the fourth interior panel.

15. The backpack set forth in claim 14, wherein the back of the third body has a front surface including a bottom pocket on the front surface, and wherein the backpack further includes an external pocket located outside of the bottom pocket, the external pocket being open at its top, a plurality of slots located on the external pocket, and a pouch having an interior compartment for transporting wet painting supplies and straps with male and female snaps, the straps being sized to fit within the slots on the front surface to couple the pouch to the front surface.

16. An assembly, comprising:

a backpack comprising:

a first body having a back, a top, a bottom, and side walls, wherein a front surface of the back forms a first interior panel having a width and comprising a single mesh pocket that extends across the width of the first interior panel and is configured to fit paint roller frames;

a second body having a back, a top, a bottom, and sides, wherein a back surface of the back forms a second interior panel comprising a plurality of upper pockets and a plurality of lower pockets that are sized and configured to hold roller covers of different sizes, and wherein a front surface of the back forms a third interior panel comprising a plurality of pockets sized to hold paint brushes of various sizes; and a third body having a back, a top, a bottom and sides, wherein a back surface of the back forms a fourth interior panel comprising pockets sized to hold putty knives of various sizes, wherein the first body and second body define a first interior compartment, wherein the second body and third body define a second interior compartment, and wherein the first and second bodies are secured together at their bottoms and held in a closed position by one or more zippers extending along the tops and sides of the first and second bodies to the bottoms of the first and second bodies where the front surface of the back of the first body faces the back surface of the back of the second body when coupled together, and the one or more zippers are movable to an open position where the front surface of the back of the first body and the back surface of the back of the second body face the same direction;

a paint roller frame configured to fit in the single mesh pocket in the first body;

a plurality of roller covers configured to be received in the plurality of upper pockets and plurality of lower pockets in the second interior panel of the second body;

a plurality of paint brushes configured to be received in the plurality of pockets in the third interior panel of the second body; and a plurality of putty knives configured to be received in the pockets in the fourth interior panel of the third body;

wherein one of the side walls of the first body has an extension pole pocket and a plurality of slots for attaching items to the backpack located on the outside of the extension pole pocket;

wherein one of the side walls comprises a first pocket adjacent to a first side of the first interior panel, a second pocket adjacent to a second side of the first interior panel, and a third pocket that is adjacent to the second side of the first interior panel, wherein the third pocket is below the second pocket.

* * * * *